US006045678A

United States Patent [19]

Morse et al.

[11] Patent Number: 6,045,678

[45] **Date of Patent: *Apr. 4, 2000**

[54] FORMATION OF NANOFILAMENT FIELD EMISSION DEVICES

[75] Inventors: Jeffrey D. Morse, Martinez, Calif.; Robert J. Contolini, Lake Oswego, Oreg.; Ronald G. Musket, Danville; Anthony F. Bernhardt, Berkeley, both of Calif.

[73] Assignee: The Regents of the University of California, Oakland, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,088

[22] Filed: May 1, 1997

[51] Int. Cl.[7] ..... C25D 5/02

[52] U.S. Cl. ..... 205/123; 445/50

[58] Field of Search ..... 445/27, 24, 50; 204/4; 205/123, 122; 313/309

[56] References Cited

U.S. PATENT DOCUMENTS

| | | | |
|---|---|---|---|
| 3,665,241 | 5/1972 | Spindt et al. | 313/351 |
| 5,150,192 | 9/1992 | Greene et al. | 357/68 |
| 5,188,977 | 2/1993 | Stengl et al. | 437/89 |
| 5,219,310 | 6/1993 | Tomo et al. | 445/24 |
| 5,382,185 | 1/1995 | Gray et al. | 445/49 |
| 5,462,467 | 10/1995 | Macauley et al. | 445/50 |
| 5,559,389 | 9/1996 | Spindt et al. | 313/310 |
| 5,562,516 | 10/1996 | Spindt et al. | 445/24 |
| 5,578,185 | 11/1996 | Bergeron et al. | 205/123 |
| 5,665,421 | 9/1997 | Bergeron et al. | 427/64 |

FOREIGN PATENT DOCUMENTS

WO 93/18536 9/1991 European Pat. Off. .

OTHER PUBLICATIONS

Busta, Heinz H. "Review—Vacuum Microelectronics—Jun. 14, 1992"; Journal of Micromechanical/Microeng 2 (1992) pp. 43–74.

Cochran et al. "Low–voltage field emission from tungsten fiber arrays in a stabilized zirconia matrix", Journal of Material Research Society vol. 2 No. 3 pp. 322–328, Jun. 1987.

Melmed, A.J. "The art and science and other aspects of making sharp tips"; Journal of Vacuum Science Technology B vol 9 No. 2; pp. 601–608, Apr. 1991.

*Primary Examiner*—Kathryn Gorgos
*Assistant Examiner*—Erica Smith-Hicks
*Attorney, Agent, or Firm*—L. E. Carnahan

[57] ABSTRACT

A process for fabricating a nanofilament field emission device. The process enables the formation of high aspect ratio, electroplated nanofilament structure devices for field emission displays wherein a via is formed in a dielectric layer and is self-aligned to a via in the gate metal structure on top of the dielectric layer. The desired diameter of the via in the dielectric layer is on the order of 50–200 nm, with an aspect ratio of 5–10. In one embodiment, after forming the via in the dielectric layer, the gate metal is passivated, after which a plating enhancement layer is deposited in the bottom of the via, where necessary. The nanofilament is then electroplated in the via, followed by removal of the gate passification layer, etch back of the dielectric, and sharpening of the nanofilament. A hard mask layer may be deposited on top of the gate metal and removed following electroplating of the nanofilament.

18 Claims, 4 Drawing Sheets

FORMATION OF NANOFILAMENT FIELD EMISSION DEVICES

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention is related to field emission devices, particularly to gated field emitters, and more particularly to the formation of a high aspect ratio nanofilament field emission device with and without gate passivation, and, where needed, plating enhancement.

In recent years substantial effort has been directed to the use of gated field emission devices in flat panel displays and in vacuum microelectronics for radiation hard performance, lower power electron sources for ion cells, and in ultrasensitive chemical sensors. For example, it is forecast that flat panel displays will be a 10–20 billion dollar per year market by the turn of the century. Currently, the flat panel displays primarily involve active matrix liquid crystals, and field emission displays are one of the leading contenders. In field emission cathodes, both the materials of the emitter and the gate, and the geometry of emitter-gate structure are very important. By forming an extremely sharp (needle-like) emitter tip centered in a small grid (gate) hole or via, emission is more uniform among the emitters and the turn-on voltage, at which electron emission is initiated, is lowered.

Recent efforts in the development of gated field emitters having sharp tips have been directed to forming the emitter by electroplating, the grid or gate metal being used in some techniques as a counter electrode. Such recent efforts which involved the formation of "nanocones" and "nanofilament" type emitters are exemplified by copending U.S. application Ser. No. 08/847,087, filed May 1, 1997, now U.S. Pat. No. 5,891,321, entitled "Electrochemical Sharpening of Field Emission Tips", and copending U.S. application Ser. No. 08/847,085, filed May 1, 1997, pending entitled "Use of a Hard Mask for Formation of Gate and Dielectric Via Nanofilament Field Emission Devices," each assigned to the same assignee. Also, selective etching of nuclear tracked materials to create a mold for electroplating nanofilament structures having a diameter of 0.5 to 1.0 micron heights has been demonstrated. See U.S. Pat. No. 5,462,467 issued Oct. 31, 1995 to J. M. Macauley et al.

These recent efforts have established that electrochemical deposition can be utilized to form nanofilament structures in oxide vias having diameters of 50–200 nm, and aspect ratios (the ratio of the height of the filament to its diamenter) of 5–10 results in a cylindrical shaped nanofilament which is self-aligned to a gate electrode on top of the dielectric. However, in order to make these prior processes more manufacturable, it has been found that it is necessary to passivate the gate structure, thereby allowing overplating to occur, thus compensating for nonuniformity in deposition rate. Furthermore, since the electroplating of the emitter may be done on a high resistivity film or resistor layer, adhesion and initiation of the electroplated material is an issue, depending on the composition of the layer on which the emitter is to be deposited. Also, the tip of the electroplated structure must form a sharp point, centered in the gate metal via, substantially in the plane of the gate metal layer.

The present invention enables manufacturably of gated emitters by a process for creating a nanofilament field emission device which involves gate metal passivation and plating enhancement. The formation of high aspect ratio, electroplated nanofilament structure devices for field emission flat panel displays, for example, requires the formation of a via in a dielectric layer which is self-aligned to a gate metal via structure on top of the dielectric layer. The desired diameter of the via in the dielectric is on the order of 50–200 nm, with an aspect ratio defined by depth divided by via diameter of 5–10. Once the via in the dielectric is created, the gate metal is passivated, after which a plating enhancement layer may be deposited in the bottom of the via. The nanofilament is then electroplated in the via, after which the gate passivation layer is removed, the dielectric etched back, and the nanofilament sharpened. The process of this invention provides more tolerance in the electroplating and sharpening than the processes of the above-referenced copending applications.

SUMMARY OF THE INVENTION

It is an object of the invention to form high aspect ratio, electroplated nanofilament structures for field emission displays.

A further object of the invention is to provide a method for fabricating nanofilament field emission devices.

A further object of the invention is to provide for the formation of nanofilament field emission devices with gate passivation.

A further object of the invention is to provide for the formation of electroplated nanofilament field emitters using plating enhancement to ensure adhesion to the resistor film of the device.

Another object of the invention is to provide a process for fabricating electroplated nanofilament emitters using gate passivation, plating enhancement, and emitter sharpening.

Another object of the invention is to provide a process for fabricating sharpened high aspect ratio electroplated emitters which enables more tolerance in the electroplating and sharpening of the emitters than prior processes.

Other objects and advantages of the present invention will become apparent from the following description and accompanying drawings. Basically, the invention involves a process for the formation of nanofilament field emission devices which may include the use of gate metal passivation to provide greater tolerance in electroplating the nanofilament. Also, depending on the composition of the layer on which the nanofilament is to be electroplated, the invention provides plating enhancement to assure uniform plating and adhesion of the nanofilament to high resistivity material. Also, the invention enables the sharpening of the tip of the thus formed nanofilament by electrochemically etching using the gate metal as a counter electrode. The process of this invention produces high efficiency field emitters, which are uniform in height and sharpness, and which are particularly applicable for use in flat panel displays and vacuum microelectronics.

BRIEF DESCRIPTION OF THE DRAWINGS

The accompanying drawings, which are incorporated into and form a part of the disclosure, illustrate operational steps for fabricating embodiments of the invention and, together with the description, serve to explain the principles of the invention.

DETAILED DESCRIPTION OF THE INVENTION

The present invention is directed to a process for creating electroplated high aspect ratio nanofilament field emission devices. The preferred process (see FIGS. 7–15) of this invention forms nanofilament field emission devices using gate passivation to provide more tolerance in the electroplating of the emitter, and where necessary provides plating enhancement to assure uniform plating and adhesion of the emitter to a desired resistive layer. The preferred process also involves nanofilament sharpening using the gate layer as a counter electrode.

The formation of high aspect ratio, electroplated nanofilament structure devices for field emission flat panel displays or vacuum microelectronics requires first the formation of a via or opening in a dielectric layer which is self-aligned to a via in a gate metal structure on top of the dielectric. The desired diameter of the via in the dielectric is on the order of 50–200 nm, with an aspect ratio of 5–10. Once the via in the dielectric is created, the gate metal in accordance with the preferred process is passivated, after which a plating enhancement layer is deposited and selectively removed except in the bottom of the via of the dielectric. The nanofilament is then electroplated in the via, whereafter the gate passivation layer is removed, the dielectric is etched back away from the nanofilament, and the nanofilament is sharpened using the gate metal as a counter electrode. This preferred process provides tolerance in the electroplating and by allowing overplating to occur compensates for non-uniformity in the deposition rate. Further, by providing a plating enhancement layer adhesion and initiation of the electroplated material to a high resistivity film can be accomplished. By sharpening the electroplated nanofilament tip by electrochemical etching using the gate metal as a counter electrode, the nanofilament of the gated field emission device produced by the process of FIGS. 7–15 of this invention has a sharp point, centered in the gate metal via, in the plane of the gate metal layer, thereby resulting in high efficiency field emitters, which are uniform in height and sharpness. The embodiment of the process illustrated in FIGS. 7–15 which allows for electrode overplating thus eases the electroplating tolerances.

The following example, in conjunction with FIGS. 1–6 illustrates a simplified process which differs from that of the FIGS. 7–15 process primarily by omitting the gate passivation layer and overplating of the filament. The formation of a stack of films or layers to compose a complete field emitter device generally comprises a substrate, a metal layer, a resistor layer, an insulating layer and a gate metal layer. For simplification the illustrated structure of FIGS. 1–6 omits the substrate and illustrates a conductive or resistive film, the insulation layer, the gate metal layer, etc.

Figure 1:
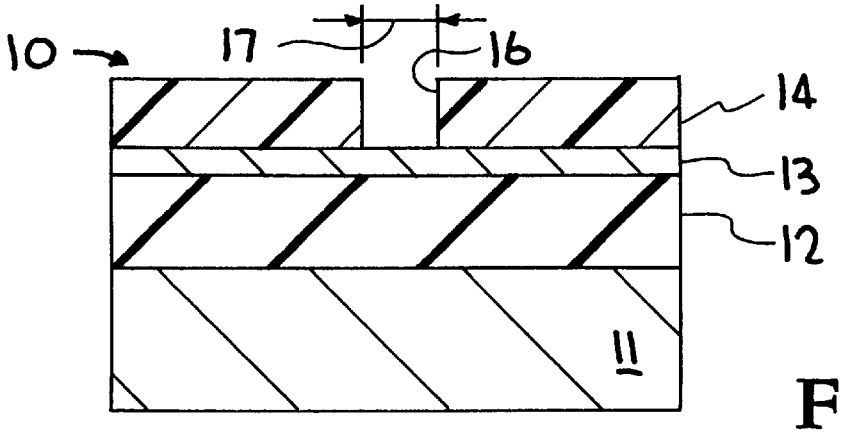
FIGS. 1–4 illustrate the formation of self-aligned vias in a first structure, in accordance with the present invention.
Figure 4:
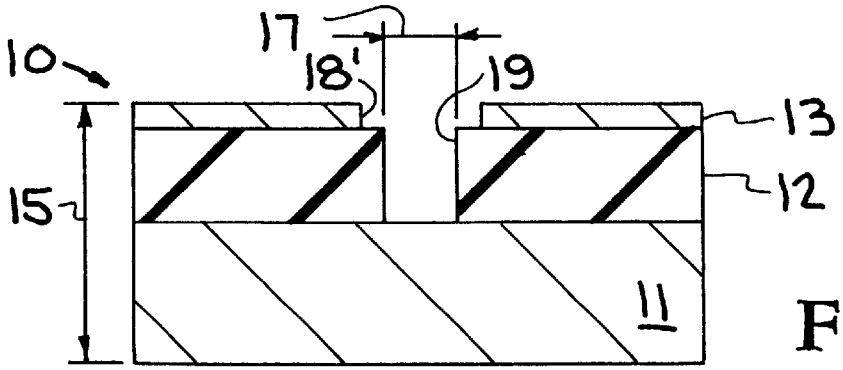
Figure 5:
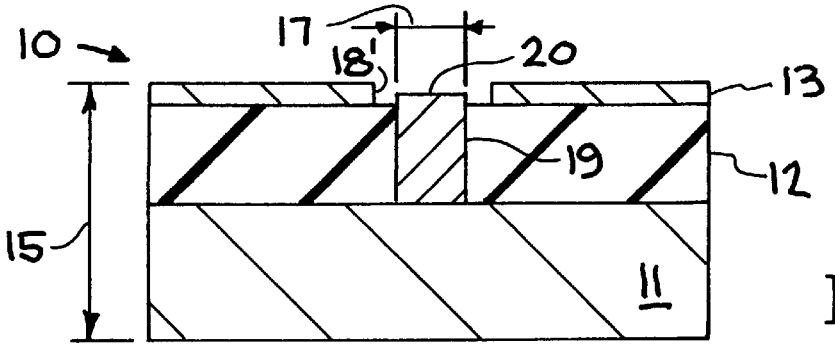
FIGS. 5 and 6 illustrate the formation of the nanofilament emitter in the structure of FIGS. 1–4, with FIG. 6 illustrating the end product.
Figure 6:
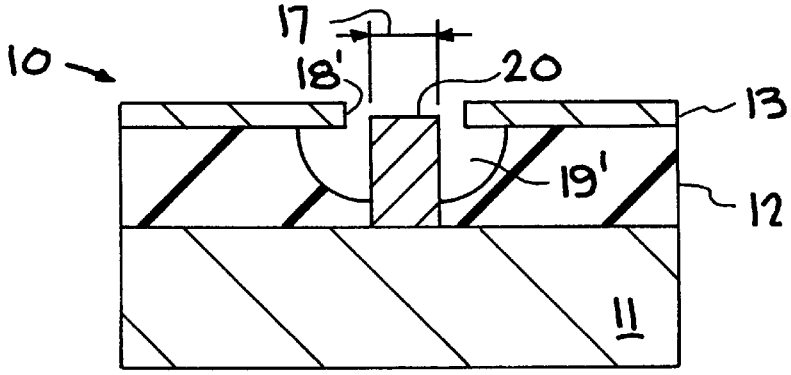

The process illustrated in FIGS. 1–6 is as follows, with FIG. 6 illustrating an embodiment of an end product produced by the process:

1. The formation of a stack of films or layers of materials to compose the field emitter device, with a mask layer or film on top, is shown in FIG. 1, and the structure, generally indicated at 10, is composed of a conductive or resistive film 11, a dielectric or insulation film or layer 12, a gate material film or layer 13, and a mask layer or film 14. For example, the layer 11 may be composed of a conductive material such as nickel, chromium, or aluminum; or a resistive material such as cermet, silicon carbide, or amorphous silicon; the dielectric layer 12 may be composed of $SiO_2$, $Si_3N_4$, or $Al_3O_4$; the gate material layer 13 may be composed of metal or conductive material, such as chromium, aluminum, or molybdenum; and the mask layer 14 may be composed of an ion trackable polymer such as polycarbonate or polyimide; an ion trackable inorganic dielectric such as $SiO_2$; or ion trackable photoresist, such as AZ4110 made by Hoechst-Celanese.

2. A pattern of nuclear tracks is formed in the mask layer 14 and these nuclear tracks are etched to form vias or openings, one such via being illustrated at 16 in FIG. 1, having a diameter of 50–200 nm as indicated by arrow 17. The etched tracks in masks layer 14 form a pattern from which vias in the underlying gate material and dielectric are patterned. The tracks may be formed by various ion tracking techniques or by other high resolution lithography. The opening or via 16 may be formed by plasma or electrochemical etching.

Figure 2:
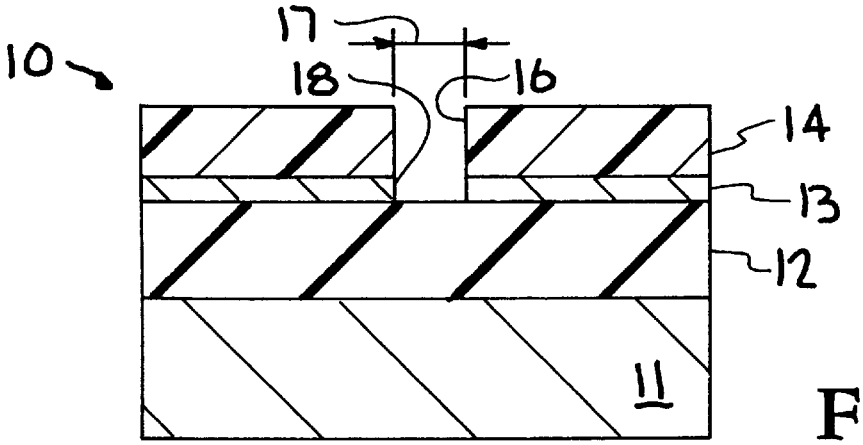

3. The mask layer pattern is transferred into the gate material layer 13 by etching, either wet or plasma etch techniques to form an opening or via 18 in layer 13, as shown in FIG. 2. With the gate material layer 13 composed of chromium, for example, etching is carried out by standard plasma etch techniques using $Cl_2/O_2$ chemistry or electrochemical etching techniques.

Figure 3:
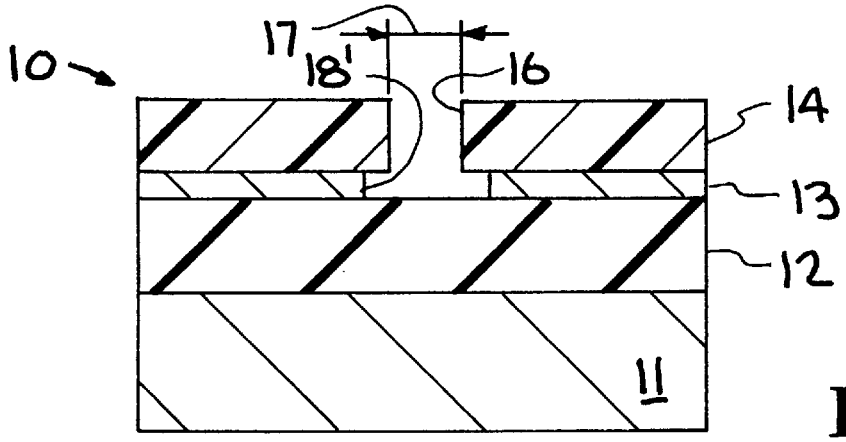

3a. Continued etching of the gate material layer 13 results in a via 18' being larger in diameter than via 16 in mask layer 14 as shown in FIG. 3.

4. A via or cavity indicated at 19 is then etched in dielectric layer 12, as shown in FIG. 4, using a high density plasma etch system which enables small feature, high aspect ratio structures to be formed therein. The advanced (high density) plasma etching is carried out by using a $CHF_3/CF_4$ chemistry. Preferably, the plasma etch system allows control of plasma density with independent control of plasma ion energy, hence directionality, thereby allowing control of vertical etch rate over horizontal etch rate.

5. The mask layer 14 is removed, as shown in FIG. 4, by dissolution with appropriate solvent, such as acetone, or selective removal during subsequent plasma etch step ($Cl_2/O_2$ will remove polycarbonate film, for example). The device (layers 11–13) may have a height, as indicated by arrow 15, of 500–800 nm, for example.

6. After forming the via or cavity 19 and removing the mask layer 14 in dielectric layer 12, an emitter structure 20 is formed in the via 19 of dielectric layer 12 and in via 18' in gate material layer 13 by electroplating. The electroplating may, for example, be carried out in a nickel sulfanate plating solution. For an Al/Cr cermet, resister layer, plating can be enhanced by initial reduction of $Cr_2O_3$ on the surface using acidic nickel sulfate solution with a pulsed voltage waveform. FIG. 5 shows the emitter 20 being above the dielectric layer 12. Shorting between the emitter 20 and gate material layer 13 is prevented by the enlargement of gate via 18'.

7. The dielectric sidewall material of layer 12 is then etched back away from the emitter structure 20 to form an enlarged cavity or via 19', as shown in FIG. 6, by wet etch in 6:1 buffered hydrofluoric acid, for example.

8. The configuration of the emitter structure is then sharpened such as by electrochemical sharpening described in above-referenced copending application Ser. No. 08/847,087, using the gate material layer 13 as a counter electrode.

Figure 7:
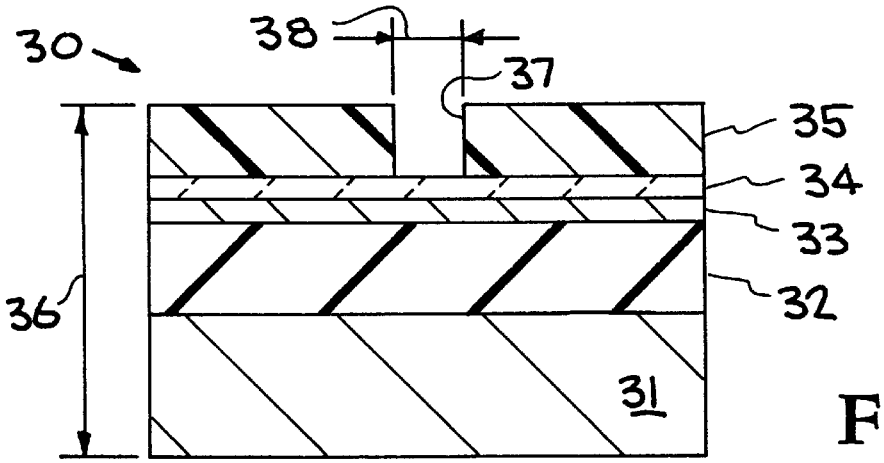
FIGS. 7–9 illustrate the formation of self-aligned vias in a second structure different than that of FIGS. 1–4.
Figure 13:
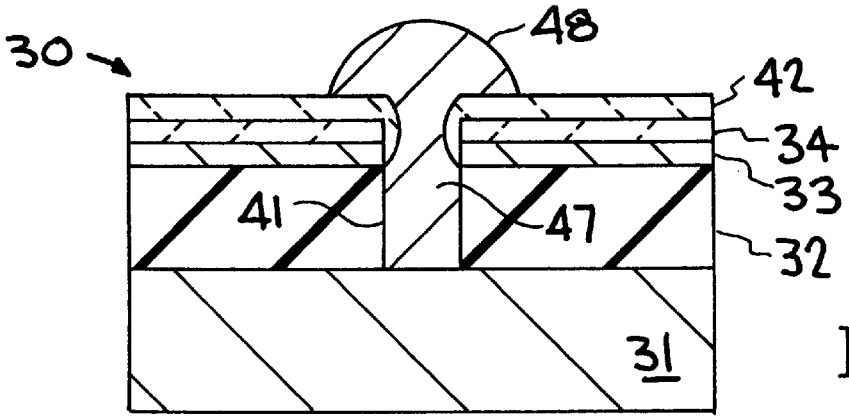
FIGS. 13–15 illustrate the formation and sharpening of the nanofilament emitter shown in FIG. 15 in accordance with the invention.
Figure 14:
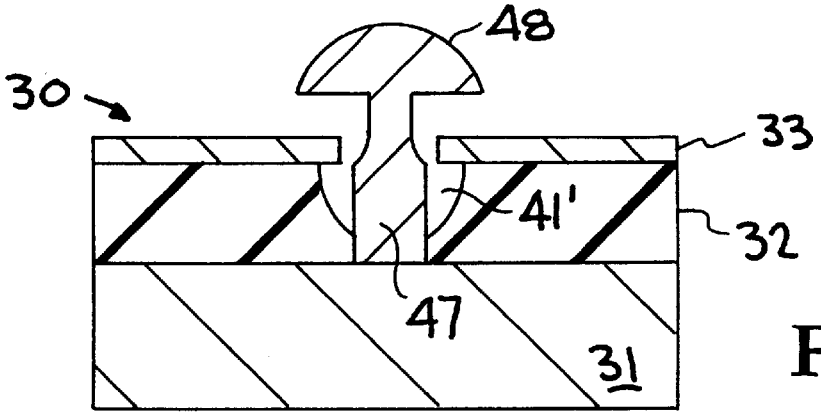
Figure 15:
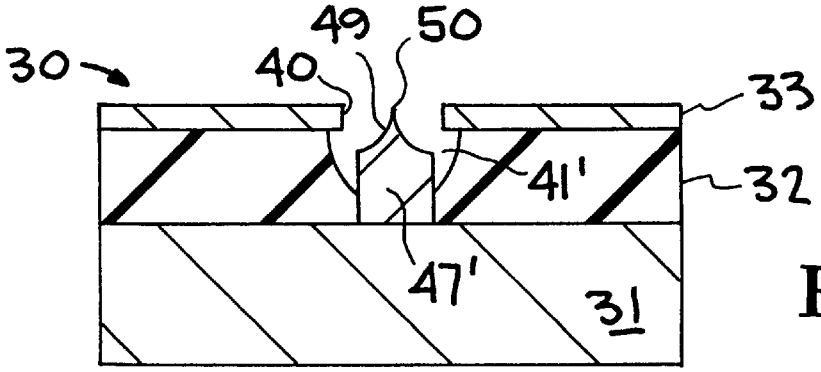

The following example, in conjunction with FIGS. 7–15, of the preferred process of the present invention is set forth hereinafter, with FIG. 15 illustrating an embodiment of a gated field emitter with a sharpened point as produced by the preferred process of this invention. The process comprises:

1. The formation of a stack of films or layers of materials to compose the field emitter device, and with a mask layer or film on top, as shown in FIG. 7. The structure of FIG. 7, generally indicated at 30 is composed of a conductive or resistive film 31, a dielectric film or layer 32, a gate material film or layer 33, an optional hard mask layer or film 34, and a mask layer or film 35. The structure 30 of FIG. 7 has a height of 350–800 nm as indicated by arrow 36. For example, the layer 31 may be composed of a conductive material such as nickel, chromium, or aluminum; or a resistive material such as cermet, silicon carbide, or amorphous silicon; the dielectric layer 32 may be composed of $SiO_2$, $Si_3N_4$, or $Al_3O_4$; the gate material layer 33 may be composed of metal or conductive material, such as chromium, aluminum, or molybdenum; the optional hard mask layer 34 may be composed of $SiO_2$, $Si_3N_4$, or $Al_2O_3$; and the mask layer 35 may be composed of an ion trackable polymer such as polycarbonate or polyimide; an ion trackable inorganic dielectric such as $SiO_2$; or an ion trackable photoresist such as AZ4110 made by Hoecht-Celanese. The structure of FIG. 7 in the process example set forth hereinafter and illustrated in FIGS. 7–15 is composed of a resistive layer 31 of cermet having a thickness of 300 nm, a dielectric layer 32 of $SiO_2$ having a thickness of 400 nm, a gate metal layer 33 of chromium having a thickness of about 50 nm, a hard mask layer 34 of $SiO_2$ having a thickness of 40 nm, and a mask layer 35 of polycarbonate having a thickness of 600 nm.

2. A pattern is created in the mask layer 35 which includes at least one opening or via 37 having a diameter of 50–200 nm as indicated by arrow 38, by known ion tracking or other high resolution lithography.

Figure 8:
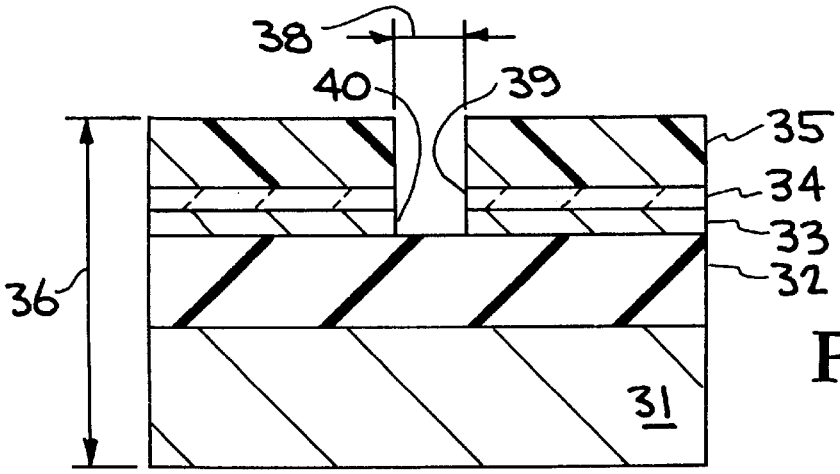

3. The mask layer pattern is transferred into the hard mask layer 34 and the gate metal layer 33 by etching, either wet or plasma etch techniques to form openings or vias 39 and 40 in respective layers 34 and 33, as shown in FIG. 8. With the hard mask layer 34 composed of $Si_3N_4$, etching is carried out by standard plasma etch techniques utilizing fluorene ($F_2$) based gas chemistries ($CHF_3$, $CF_4$, $SF_6$, etc.) in parallel plate configuration in reactive ion or high density plasma etch mode. With the gate metal layer 33 composed of chromium, etching is carried out by standard plasma etch techniques using $Cl_2/O_2$ chemistry or electrochemical etching techniques.

Figure 9:
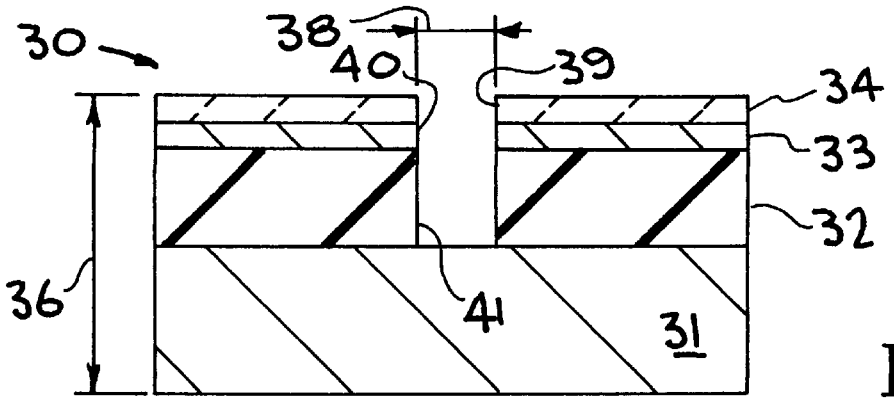

4. The mask layer 35 is removed, as shown in FIG. 9, by dissolution with appropriate solvent, such as acetone, or selective removal during subsequent plasma etch step ($Cl_2/O_2$ will remove polycarbonate film).

5. A via or cavity indicated at 41 is etched in dielectric layer 32 as shown in FIG. 9 using a high density plasma etch system which enables small feature, high aspect ratio structures to be formed therein. The advanced plasma etching is carried out by using $CHF_3/CF_4$ chemistry. Preferably, the plasma etch system allows control of plasma density with independent control of plasma ion energy, hence directionality, thereby allowing control of vertical etch rate over horizontal etch rate.

5a. If the etch selectivity of the hard mask layer 34 during the dielectric layer etch is not high enough such that some of the dielectric layer remains, additional layers composed of silicon or chromium, for example, can be deposited on top of the plating standoff layer to protect it during these etch steps.

Figure 10:
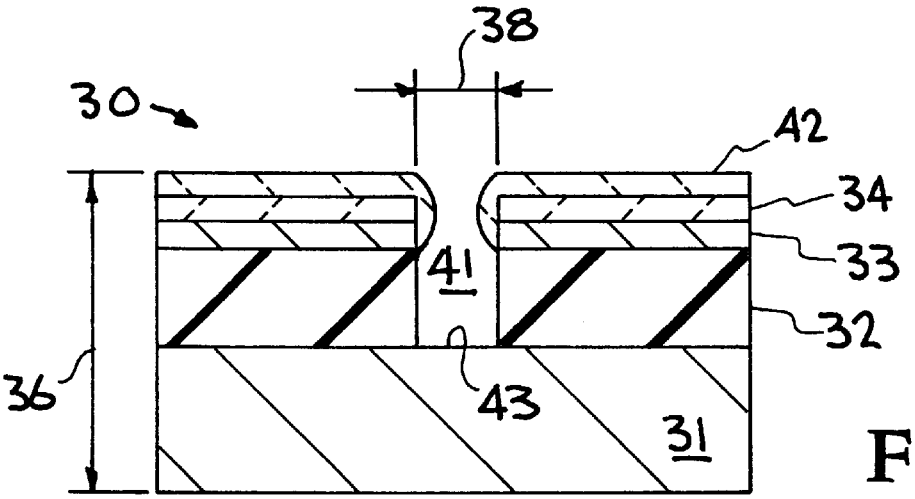
FIGS. 10–12 illustrate the formation of gate passivation and plating enhancement layers on the structure of FIG. 9, pursuant to the invention.
Figure 11:
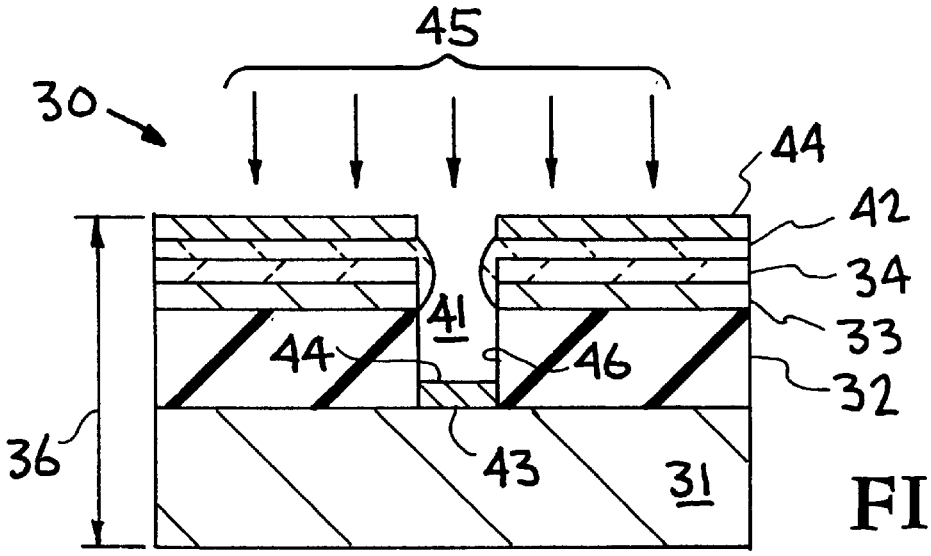

6. After forming the via or cavity in the dielectric layer 32, a gate passivation layer 42, composed of an insulator such as silicon dioxide ($SiO_2$), is deposited on the top of hard mask layer 34 and in the vias or openings 39 and 40 of layer 34 and gate metal layer 33 to a thickness, for example, of about 30 nm, as shown in FIG. 10. Other insulator materials (polymers or oxides) such as $Si_3N_4$, $Al_2O_3$, polyimide, or $\alpha$-silicon may be used depending on the composition of the hard mask and gate metal layers. It is important that the gate passivation layer 42 is deposited in such a manner that the bottom 43 of the via or cavity 42 in dielectric layer 32 does not get coated, otherwise an additional etch would be required to remove any insulator material from the bottom of the cavity 41. By way of example, the gate passivation layer 42 is deposited by using nonconformal techniques such as sputtering or PECVD with appropriate power and pressure adjustments with the dielectric cavity having an aspect ratio greater than 2.5:1 for the gate diameters specified. Other techniques can be utilized to passivate the gate metal layer 43, for example, electroplating of photoresist polyimide, or other dielectric, or oxidation of the gate material by anodization or oxide plasma.

7. Next, a thin seed or plating enhancement film or layer 44, see FIG. 11, may be deposited on the top surface of passivation layer 42 and on the bottom 43 of dielectric via or cavity 41, and may, for example, be composed of chromium (Cr) with a thickness of 1–10 nm. It is important that the enhancement material deposition is highly directional as indicated by arrows 45 in FIG. 11 such that the sidewalls 46 of the cavity 41 are not coated. The gate passivation layer 42 will act to shadow the sidewalls 46 in this event. E-beam evaporation or directional sputtering is adequate for directionally depositing the plating enhancement layer 44.

7a. Alternative steps can be included to improve adhesion and plating to the underlying resistive film or layer 31 at the bottom 43 of dielectric cavity 41. These include heating the resistive layer 31 or chemical surface cleaning, chemical or electrochemical etching, sputtering, or even high energy ion irradiation of the surface of the resistive layer 31. The gate passivation and hard mask layers 42 and 34 will protect the dielectric layer 32 and the gate metal layer 33 from these above described steps.

Figure 12:
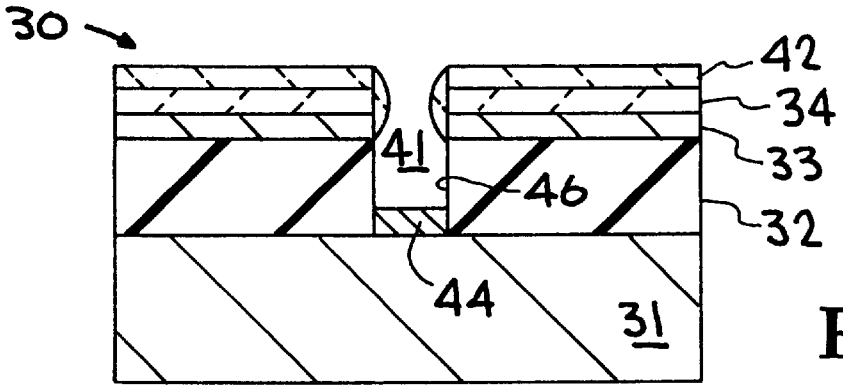

8. The plating enhancement layer 44 is selectively etched except in the bottom 43 of cavity or via 41, as shown in FIG. 12. This may be done, for example, at appropriate plasma etching power and pressure.

8a. If electroplating of the nanoemitter structure can be easily accomplished on the resistive layer 31 or can be accomplished by a simple cleaning or etch of the resistor layer prior to plating, the plating enhancement layer 44 is not necessary.

9. Form an emitter structure 47 in the vias 41, 40, and 39 of layers 32, 33, and 34 by electroplating as shown in FIG. 13, wherein overplating indicated at 48 is allowed as discussed above. The electroplating may, for example, be carried out in a nickel sulfanate plating solution. For an Al/Cr cermet resistor layer, plating can be enhanced by initial reduction of $Cr_2O_3$ on the surface using acidic nickel sulfate solution with a pulsed voltage waveform.

10. The gate passivation layer 42 and hard mask layer 34 are then removed, as shown in FIG. 14 using either wet or dry etch techniques. To remove the layer 42, composed of $SiO_2$, the etching is carried out by wet etch with 6:1 buffered hydrofluoric acid or plasma etch with standard $CF_4/O_2$ chemistry at appropriate power and pressure. To remove the layer 34, composed of $Si_3N_4$, the etching is carried out by wet etch in hot phosphoric acid or plasma etch with standard $CF_4/O_2$ chemistry at appropriate power and pressure.

11. The dielectric sidewall material of layer 32 is then etched back away from the emitter structure to form an enlarged via or cavity 41', as also shown in FIG. 14. This operation may be consolidated with the operation of step 10 above, depending on the etchants utilized. If separately etched, the dielectric sidewall etching may be carried out by wet etch in 6:1 buffered hydrofluoric acid.

12. The configuration of emitter structure 47 is then formed as shown at 47' in FIG. 15, and the tip 49 of the emitter is sharpened to produce a point 50. The configuration of the nanofilament or emitter 47' and tip 49 with sharpened point 50 are formed by etching. An electrochemical etching process, which uses the gate metal layer 33 as a counter electrode, is described and claimed, for example, in above-referenced copending application Ser. No. 08/847,087. Briefly this etching technique is carried out by etching a nickel nanofilament using a sulfuric acid solution and a pulsed voltage applied between the cathode and gate electrode so that nickel nearest the gate is preferentially etched. Note that the point 50 of tip 49 is centered in via 40 of gate metal layer 33 and is in the plane of the gate metal layer, as seen in FIG. 15.

13. If needed, the dielectric cavity 41' can be further etched back from the nanofilament or emitter 47'.

It has thus been shown that the present invention provides a process for fabricating high aspect ratio nanofilaments or emitters for field emission devices, such as flat panel displays and vacuum microelectronics. The preferred process involves three advantageous features: 1) passivation of the gate material, 2) plating enhancement, and 3) sharpening of the emitter tip, which provide for electroplating tolerance, uniform plating, and adhesion of the emitter to a resistive film, thereby providing high efficiency field emitters, which are uniform in height and sharpness. Because of the small dimensions permitted by the process, lower electron emission initiation voltage is obtained.

While particular embodiments and particular sequences of process steps, along with specified materials, parameters, etc., have been set forth to exemplify and describe the principles of the invention, such are not intended to be limiting. Modifications and changes may become apparent to those skilled in the art, and it is intended that the invention be limited only by the scope of the appended claims.

The invention claimed is:

1. A process for electroplating a nanofilament in a gated field emission device having a layer of conductive or resistive material, comprising:

forming a structure consisting of a layer of conductive or resistive material, a layer of dielectric material, a layer of gate material, a layer of hard mask material, and a layer of mask material, forming a via in the mask material layer, the hard mask material layer, and the gate material layer, forming a high aspect ratio, small diameter via in the dielectric layer under the gate material layer via by highly directional, selective plasma etching to expose an area of the layer of conductive or resistive material, forming a passivation layer on, the hard mask material layer and the gate material layer with the passivation layer covering over the edge of the via in the hard mask material layer and the gate layer, and onto sidewalls of the dielectric layer at the extreme top of the dielectric via, so as to form a via in the passivation layer, forming a plating enhancement layer on at least the bottom of the via of the dielectric layer, forming by electroplating an emitter structure in the via of at least the dielectric and gate material layers, removing at least the passivation layer, etching back the dielectric material from around the thus formed emitter structure, configuring the emitter structure, and sharpening the tip of the emitter structure.

2. The process of claim 1, wherein sharpening of the tip is carried out by electrochemical etching using the gate material layer as a counter electrode.

3. The process of claim 1, additionally including removing the hard mask layer following removing the passivation layer after electroplating of the nanofilament.

4.The process of claim 3, wherein the sharpening of the tip is carried out by electrochemical etching using the gate material layer as a counter electrode.

5. The process of claim 1, wherein the layer of mask material is selected from the group consisting of trackable polymers, inorganic dielectrics, and photo-resist materials.

6. The process of claim 5, additionally including removing the mask layer prior to forming a via in the dielectric layer.

7. The process of claim 1, wherein the plating enhancement layer is directionally formed such that it is deposited only on upper surfaces of the passivation layer and on the exposed area adjacent the via in the dielectric layer.

8. The process of claim 7, additionally including removing the plating enhancement layer from the upper surfaces of the passivation layer prior to forming the emitter structure.

9. The process of claim 8, wherein the emitter structure is electroplated so as to provide overplating of the emitter structure above the passivation layer.

10. The process of claim 1 wherein the emitter structure is electroplated so as to be equal with the gate material layer.

11. The process of claim 9, wherein in addition to removing the passivation layer, the layer of hard mask material is removed prior to removal of the overplated portion of the emitter structure.

12. The process of claim 9, additionally including removing the overplated portion of the emitter structure, and wherein sharpening of the tip of the emitter structure is carried out such that a point is formed on the tip and is located substantially centrally in the via of the gate material layer.

13. A process for forming a high aspect ratio, electroplated nanofilament structure device for field emission, comprising:

providing a structure consisting of a layer of conductive or resistive material, a layer of dielectric material, a layer of gate material, a layer of hard mask material, and a layer of mask material, forming at least one via in the mask material layer, the hard mask layer, and in the gate material layer, removing the mask material layer, forming at least one high aspect ratio, small diameter via in the dielectric material layer aligned with the at least one via in the gate material layer by highly directional, selective plasma etching, forming a passivation layer over the hard mask layer and the gate material layer and which extends into the at least one via therein and onto the sidewalls of its insulating layer at the extreme top of the dielectric via, forming a plating enhancement layer on at least one surface of the layer of conductive or resistive material at the bottom of the at least one via in the dielectric material layer, forming an emitter structure in the via of the dielectric, the gate material, and the hard mask layer, removing the passivation layer and the hard mask layer, removing dielectric material adjacent the emitter structure to form a cavity, configuring the emitter structure so as not to extend above the gate material layer, and forming a tip on the emitter structure to define a nanofilament emitter having a pointed tip located substantially in the center of the at least one via in the gate material layer.

14. The process of claim 13, wherein at least the forming of the tip of the emitter structure is carried out using the gate material layer as a counter electrode.

15. The process of claim 13, wherein the passivation layer is formed on the hard mask layer and on a sidewall of the at least one via therein with said passivation layer covering over the edge of the hard mask and gate layers onto the sidewalls of the insulating layer at the extreme top of the dielectric via.

16. The process of claim 15, wherein the plating enhancement layer is directionally formed on upper surfaces of the passivation layer and at the bottom of the at least one via in the dielectric material layer, the passivation material in the at least one via of the hard mask layer and the gate material layer preventing depositing of the plating enhancement material on the sidewalls of the at least one via in the dielectric material layer.

17. The process of claim 13, wherein forming the plating enhancement layer is omitted, and wherein the at least one surface of the layer of conductive or resistive material is processed so as to enable forming the emitter structure directly on the layer of conductive or resistive material.

18. The process of claim 13, wherein forming the emitter structure is carried out by overplating same to be above the gate material layer.

* * * * *